United States Patent [19]

Warner

[11] Patent Number: 4,474,195

[45] Date of Patent: Oct. 2, 1984

[54] NAIL POLISH REMOVAL DEVICES HAVING SUPPLY CONTAINERS

[76] Inventor: Ronald C. Warner, 4105 Albon Rd., Monclova, Ohio 43542

[21] Appl. No.: 382,410

[22] Filed: May 26, 1982

[51] Int. Cl.[3] ..... A45D 29/18

[52] U.S. Cl. ..... 132/73; 132/73.5; 132/74.5; 132/75; 401/7; 401/205

[58] Field of Search ..... 132/73, 73.5, 74.5, 132/75; 401/7, 118, 119, 120, 126, 130, 205, 207; 222/207, 454, 416; 15/104.92

[56] References Cited

U.S. PATENT DOCUMENTS

| | | | |
|---|---|---|---|
| 188,659 | 3/1877 | Newton | 401/205 |
| 1,753,044 | 4/1930 | Culver | 132/73 |
| 1,929,884 | 10/1933 | Fisher | 401/205 X |
| 2,699,885 | 1/1955 | McClure | 401/205 X |
| 3,220,618 | 11/1965 | Lodding et al. | 222/416 |
| 4,282,891 | 8/1981 | Duceppe | 132/73.5 |
| 4,321,936 | 3/1982 | Chaconas | 132/73.5 X |

FOREIGN PATENT DOCUMENTS

| | | | |
|---|---|---|---|
| 127771 | 6/1948 | Australia | 222/454 |
| 49759 | 4/1982 | European Pat. Off. | 132/73 |
| 8002497 | 11/1980 | PCT Int'l Appl. | 401/130 |
| 1559542 | 1/1980 | United Kingdom | 222/454 |

*Primary Examiner*—Steven A. Bratlie
*Attorney, Agent, or Firm*—Kenneth E. Darnell

[57] ABSTRACT

A device for treating the fingernails and particularly for removal of nail polish from the nails, the invention provides a treatment container having an absorbent member disposed therein which is soaked with a liquid nail polish removal solvent, at least one finger being received within an aperture formed in the absorbent member to contact the nail with the solvent and with surfaces of the aperture to remove a polish coating from the nail. The invention particularly provides a supply container on which the treatment container can be carried, the interior of the supply container connecting with the interior of the treatment container through a valve in a cap element closing the supply container, thereby to allow liquid nail polish removal solvent stored within the supply container to be dispensed as desired into the treatment container. A user of the present device can thus replenish the supply of liquid nail polish removal solvent within the treatment container when usage of the treatment container renders a previous charge of the liquid solvent unfit for use.

20 Claims, 10 Drawing Figures

FIG. 1
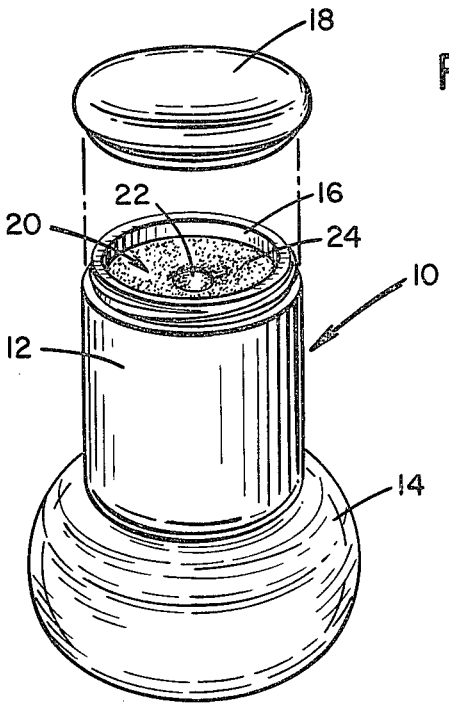
FIG. 2
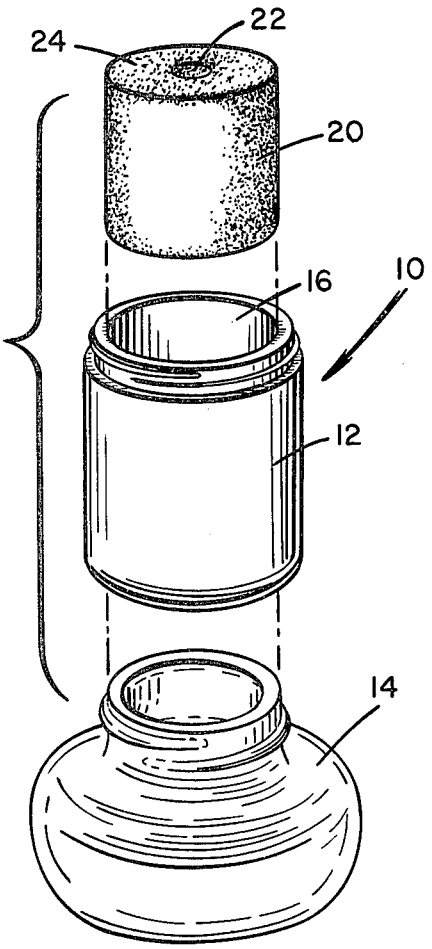
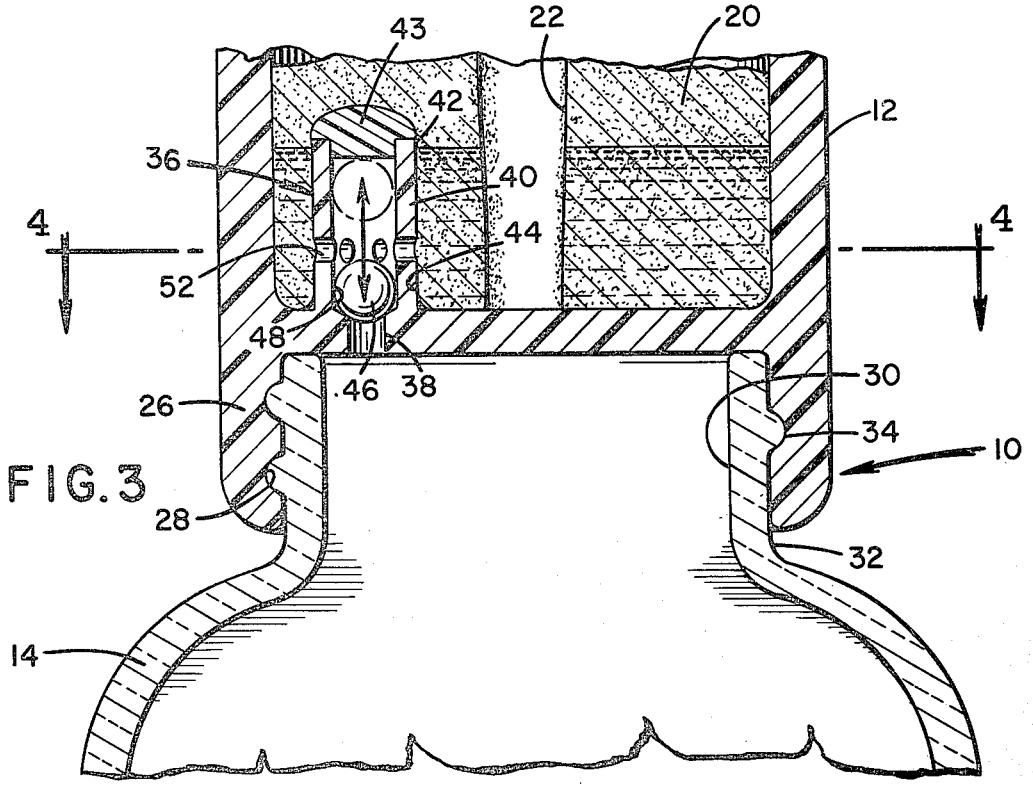
FIG. 3

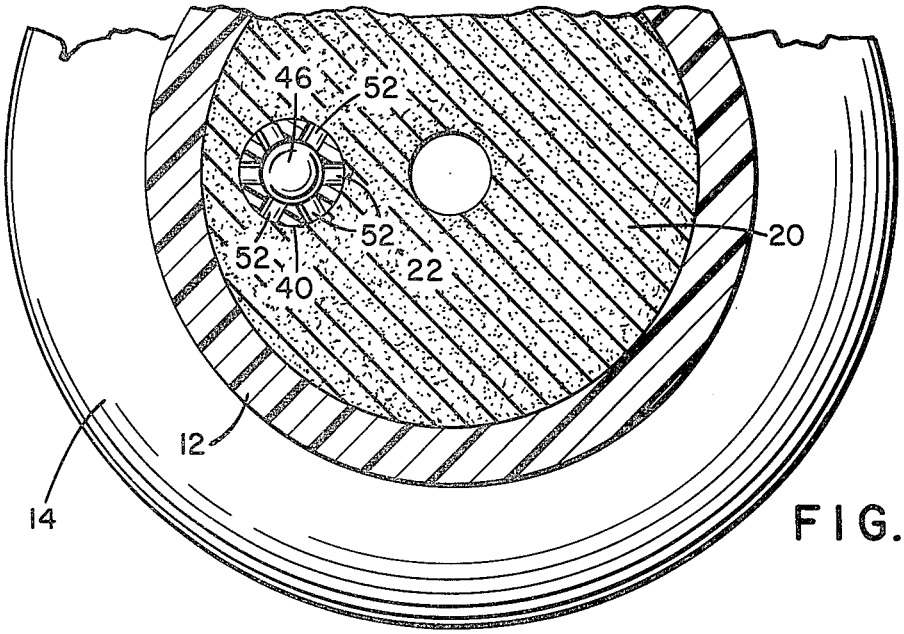
FIG. 4
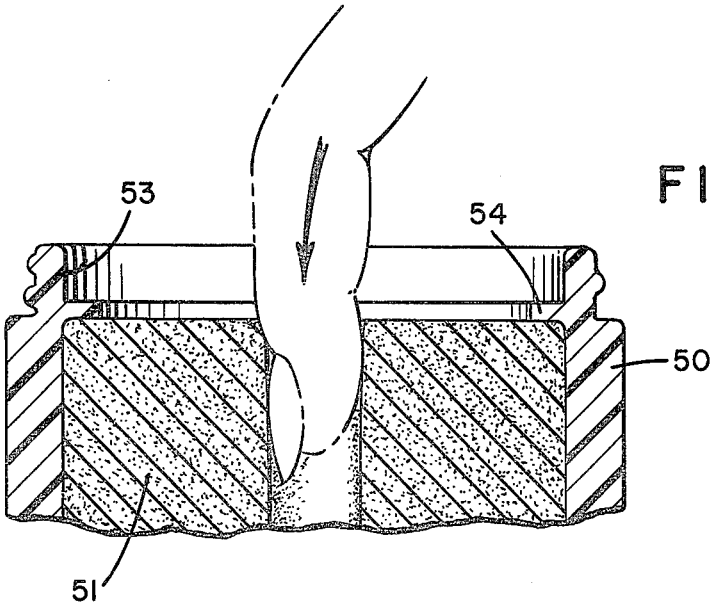
FIG. 5
FIG. 6
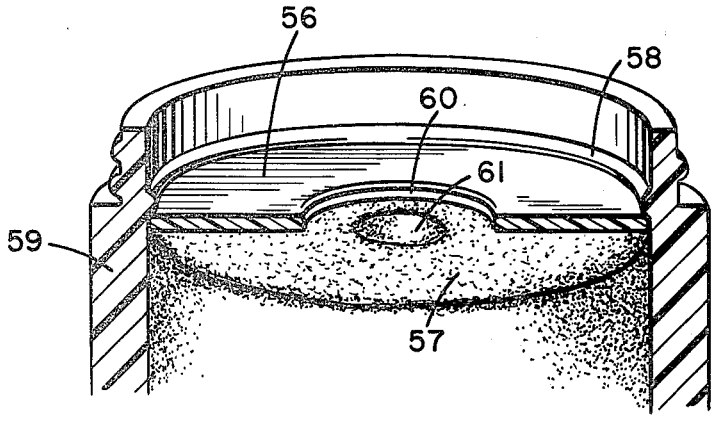

FIG. 7a
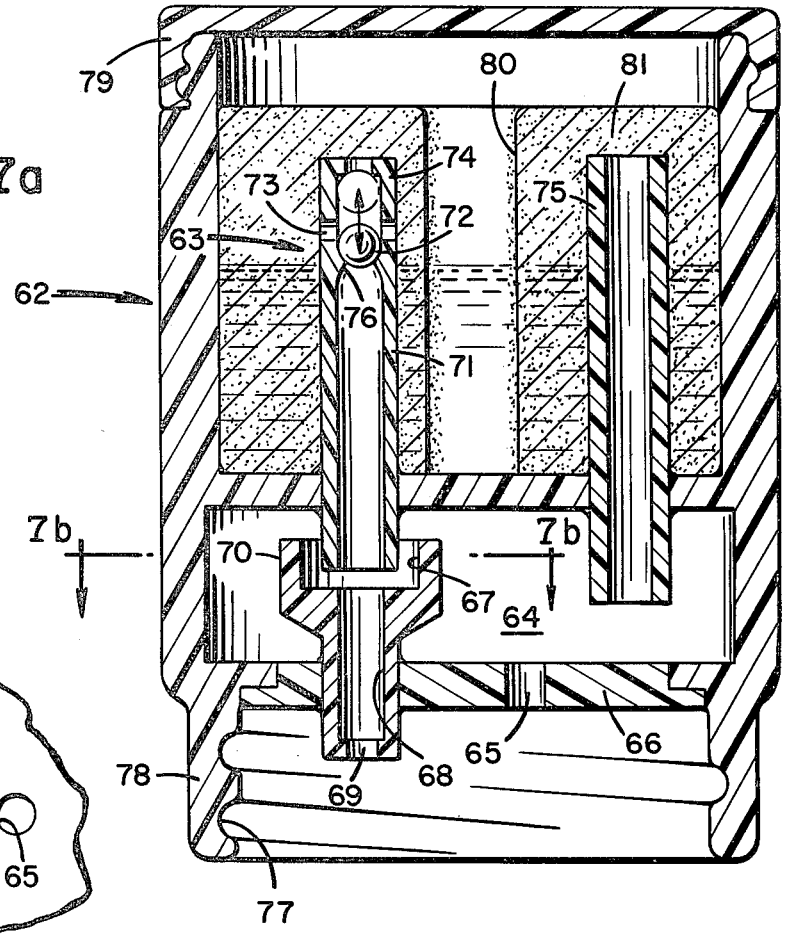
FIG. 7b
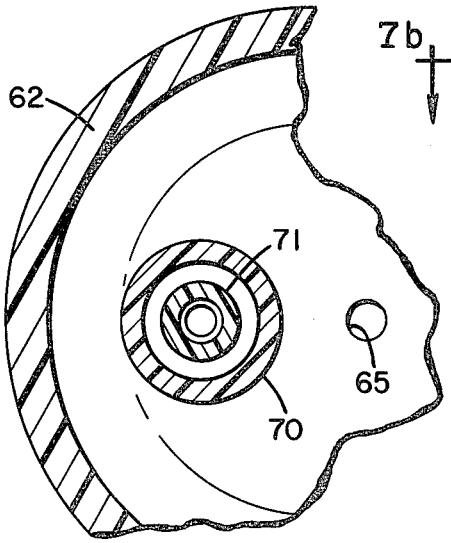
FIG. 9
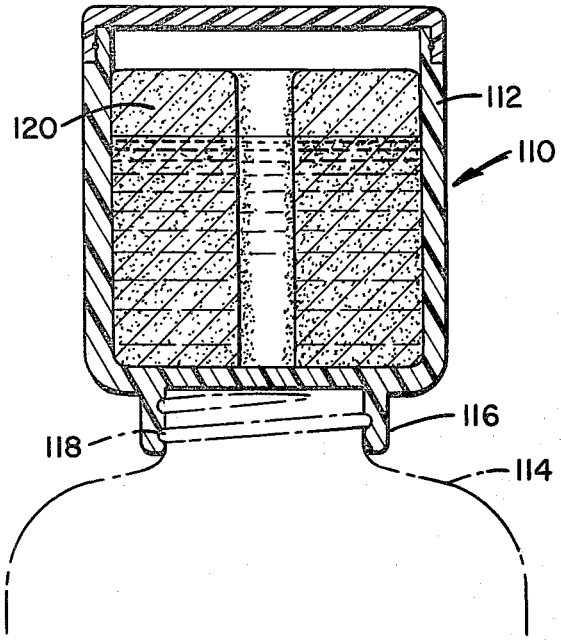
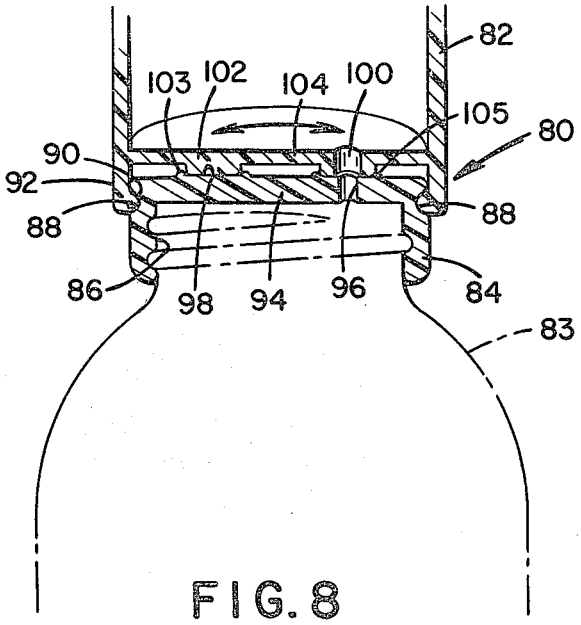
FIG. 8

NAIL POLISH REMOVAL DEVICES HAVING SUPPLY CONTAINERS

BACKGROUND OF THE INVENTION

1. Field of the Invention

The invention generally relates to devices for removal of nail polish and similar coatings from the nails and particularly to devices containing an apertured absorbent member wetted with a liquid nail polish removal solvent for receiving at least one finger into contact with the absorbent member to remove polish from the nail.

2. Description of the Prior Art

The coating of the nails for decorative and protective purposes has long been practiced, such coatings typically being applied as liquids which rapidly dry to form a solid coating on the nail. Presently available nail coatings are generally known as nail "polish" and have reached a state of development whereby the polish coating can be rapidly applied by means of a brush or similar implement and which rapidly dry to form a durable covering for the nail. Even though presently available nail polish coatings are durable as well as decorative, these coatings remain subject to chipping, peeling or similar marring after a certain period of use and must be removed for application of a fresh coating of polish when damage to the coating occurs. Nail polish is also removed even though not damaged in order to match nail polish color to a wardrobe change or to a change in personal mood. For these reasons, it becomes necessary for a user of nail polish to remove polish to allow application of a fresh polish coating as frequently as one or more times daily and almost invariably on the order of two to three times weekly. The most commonly used method for removing nail polish involves the relatively time consuming and messy practice of soaking a cotton pad or tissue with a liquid nail polish removal solvent, this solvent typically being available in a pre-packaged bottle such as is commonly marketed at retail. According to this commonly used prior practice, nail polish is removed from each nail individually by contacting the wetted piece of absorbent material with the coated nail until the polish coating softens and at least partially dissolves. The wetted material is also moved over the nail to mechanically assist in the dissolution and removal of the polish from the nail. Accordingly, it can be seen that this prior practice involves a substantial amount of time and, due to the necessity for wetting an absorbent piece of material with a liquid contained within a bottle, the liquid solvent is subject to spillage with attendant risk of soiling clothing, furnishings and the like. The prior practice further involves a certain degree of messiness which can prove objectionable due to the fact that wet absorbent material must be handled and dissolved nail polish can be smeared upon the hands and fingers as well as on clothing and furnishings unless diligence is exercised to prevent such occurrences.

The desirability of providing an improved method for removal of nail polish from the nails has long been recognized in the art as is clearly shown by the nail polish removal devices disclosed by Roosa and Merrit, respectively, in U.S. Pat. Nos. 2,524,681 and 2,629,124. According to the disclosures of these patents, receptacles having a supply of liquid nail polish removal solvent contained therein are fitted with brush-like elements disposed adjacent to or within the body of the liquid solvent. A user of a device such as is disclosed by Roosa or Merrit inserts each finger individually into the receptacle through a closable opening to contact the polish-bearing nail with the liquid solvent in order to soften or dissolve the polish, the brush-like element being used to mechanically abrade the softened polish coating for more rapid loosening thereof. While devices such as those disclosed by Roosa and Merrit do serve to facilitate removal of nail polish from the nails, certain objections to the use of these devices exist. In particular, a free-standing body of liquid solvent is contained within these devices and is subject to spillage or splatter. Further, the body of liquid solvent becomes rapidly colored and otherwise contaminated with polish after only a few uses, thereby rendering the devices less attractive to a user. Users of such devices often object to the pricking of the skin caused by the bristles of the bursh-like element contained within these devices. For reasons such as those noted, devices such as those disclosed by Roosa and Merrit have not come into general use.

U.S. Pat. No. 2,961,682 to Wurmbock et al is exemplary of the further development of manicuring devices intended for personal use in the removal of polish and other coatings from the nails. As disclosed by Wurmbock et al an absorbent member saturated with nail polish remover is held within a container having a closable opening, the absorbent member being provided with a finger-receiving aperture into which at least the distal phalanx of each finger is received one at a time. The coated nail on each finger is thus brought into contact with the polish removing solvent carried by the absorbent member, the solvent acting to soften or dissolve the polish coating from the nail. Mechanical abrasion provided by the absorbent member facilitates removal of polish from the nail. Duseppe, in U.S. Pat. No. 4,282,891, provides a nail polish removal device which is essentially identical in structure and method of use to the device of Wurmbock et al. Duseppe utilizes a foam-like plastic material of fine, high density cellular structure as the absorbent member and which is substantially identical in function to the absorbent member of Wurmbock et al. The devices of both Wurmbock et al and Duseppe provide finger-receiving apertures in their respective absorbent members which extend only partially through the absorbent members. The devices of Wurmbock et al and Duseppe are also utilized by practice of an identical method of use, that is, by insertion of each finger into the finger-receiving aperture of the absorbent members to remove polish from each nail. The devices of Roosa and Merrit described above are also utilized by a substantially identical method of use. While nail polish removal devices such as are disclosed by Wurmbock et al and Duseppe provide improvement over the devices of Roosa and Merrit, it is to be noted that a certain degree of use of the Wurmbock et al and Duseppe devices results in a coloring of the liquid solvent contained within the receptacle which holds the absorbent member. While the liquid solvent retains its polish removal capabilities well beyond that point at which the liquid solvent becomes colored, a user of such a device begins to view the device as being contaminated and typically prefers to discard the device prior to the end of the useful life of the device. The actual useful lifetime of such devices are therefore considerably foreshortened unnecessarily due to this "contamination" caused by the accumulation of dissolved polish within the device. In the devices of Wurmbock et al and Duseppe, as well as in those similar nail polish removal devices presently marketed, the user of the device is unable to remove the absorbent member from the receptacle for cleaning since such removal results in the loss of all of the liquid solvent within the receptacle, there being no self-contained capability provided with such devices for replenishment of liquid solvent to the device.

The present invention provides self-contained structure including structure useful in the manner of a fingernail polish removal device and which is provided with a substantially integral supply container which enables the recharging of the nail polish removal device with fresh liquid solvent as is necessary according to use of the device. The present invention thus provides to a user the temporal and handling advantages characteristic of presently available fingernail polish removal devices and further provides the capability of replenishing used liquid solvent, thereby extending the useful life of a nail polish removal device. Substantial advantages over the prior art are thus provided by the present invention, these advantages being of a nature not foreseen in the long history of the search for improvement in the manner by which nail coatings are removed from the nails.

SUMMARY OF THE INVENTION

The invention particularly provides devices for treating the fingernails such as by removal of fingernail polish from the nails. In all embodiments of the present invention, nail polish removal devices are provided which include a nail treatment container having an absorbent member disposed therein which is wetted with a liquid nail polish removal solvent and which has at least one aperture for receiving a finger thereinto for contact between a polish coated nail and the liquid solvent absorbed into the absorbent member. The several embodiments of the invention further include a supply container on which the treatment container can be carried, the supply container holding a supply of liquid nail polish removal solvent sufficient to recharge the treatment container a multiple number of times. The supply container can particularly be formed of glass in order to eliminate evaporation of the liquid solvent therefrom, a condition which typically occurs to at least some degree from the plastic materials from which nail polish removal devices are typically formed. Particular embodiments of the invention provide a valved cap element which closes the supply container and which typically carries the treatment container, the interior of the supply container communicating with the interior of the treatment container through the valved cap element to allow controlled charging of liquid solvent from the supply container into the treatment container when replenishment of the liquid solvent within the treatment container is required. Liquid nail polish removal solvent is thus stored within the supply container with essentially no loss of the solvent and is then dispensed as desired into the treatment container such as after cleaning of the absorbent member to remove used liquid solvent therefrom.

The present structures provide particular advantages over the nail polish removal devices of the prior art as noted herein and over reservoir bottle structures such as are disclosed by Williams et al in U.S. Pat. No. 1,034,177 and Rosenstein in U.S. Pat. No. 1,098,976. Williams et al describes a bottle having a cap which mounts a reservoir for nail polish, the reservoir being in turn covered by a second cap element bearing a buffer pad. Rosenstein describes a bottle cap having a bleed hole which is adapted to feed the contents of a bottle dauber element carried by the cap, thereby to allow application of the contents of the bottle to a surface which is to be coated with polish, paint or the like. These prior structures do not provide the particular structures of the present invention nor does this prior art function in the manner of the embodiments of the present invention. In contradistinction to the prior art, the embodiments of the present invention provide self-contained nail polish removal devices having a treatment portion thereof capable of removing nail polish from the nails in a rapid and clean fashion while allowing replenishment of liquid nail polish removal solvent from a supply portion of the devices on cleaning of an absorbent element which forms a primary portion of the treatment portion of the devices. The absorbent element of the treatment portion of the devices can thus be cleaned without concern for the total loss of all liquid solvent from the self-contained device. Further, due to the ability to form the supply portion of the self-contained devices of the invention from a material such as glass and to also form the supply portion with a relatively smaller diameter opening than is possible with the nail treatment devices of the prior art, loss of liquid solvent through the walls of the devices as well as through closable openings thereof is substantially reduced.

It is accordingly an object of the present invention to provide nail polish removal devices having treatment portions and liquid solvent supply portions whereby the treatment portion can be replenished with liquid solvent as necessary.

It is another object of the present invention to provide self-contained nail polish removal devices wherein a liquid solvent supply container is closed and surmounted by a treatment container, the interior of the supply container communicating with the interior of the treatment container through a valve element located between said containers and particularly in a cap element closing the supply container, thereby to allow liquid nail polish removal solvent stored within the supply container to be dispensed as required into the treatment container.

It is a further object of the present invention to provide nail polish removal devices for treatment of the nails to remove polish coatings therefrom and which include a self-contained supply of nail polish removal solvent, the structure of the self-contained devices acting to reduce loss of the liquid solvent by evaporation through walls and openings of the devices.

Further objects and advantages of the invention will become more readily apparent in light of the following detailed description of the preferred embodiments.

BRIEF DESCRIPTION OF THE DRAWINGS

FIG. 1 is a perspective view of a particular embodiment of the present invention;

FIG. 2 is an exploded view illustrating the various components which comprise a first embodiment of the invention;

FIG. 3 is an elevational view in section of a particular embodiment of the invention such as is seen in FIG. 2;

FIG. 4 is a detailed view taken in section along line 4—4 of FIG. 3;

FIG. 5 is a detailed elevational view in section illustrating an annular ridge element which acts to hold an absorbent element within a treatment portion of the present devices;

FIG. 6 is a perspective view in section illustrating the use of a retainer element for retaining absorbent members within the treatment portions of the present devices;

FIG. 7*a* is an elevational view in section illustrating a metering valve used as an exemplary embodiment of the invention;

FIG. 7*b* is a section taken along line 7*b*—7*b* of FIG. 7*a*;

FIG. 8 is an elevational view in section illustrating a further embodiment of the invention; and FIG. 9 is an elevational view in section illustrating a still further embodiment of the invention whereby the structure does not provide communication between a supply portion and a treatment portion of the structure.

DESCRIPTION OF THE PREFERRED EMBODIMENTS

Referring now to the drawings and particularly to FIGS. 1–4, a nail polish removal device configured according to a first embodiment of the invention is seen generally at 10 to comprise a nail treatment container 12 and a supply container 14. The treatment container 12 is seen to generally take the form of a cylinder open at its upper end and being closable at opening 16 by means of a threaded lid 18. The treatment container 12 has an absorbent member 20 disposed therein, the absorbent member 20 being similarly shaped in the form of a cylinder and having a central aperture 22 formed therein, the aperture 22 preferably extending essentially throughout the height of the absorbent member from exposed face 24 to the opposite face of said absorbent member. The absorbent member 20 is impregnated or otherwise wetted with a liquid nail polish removal solvent which contacts a nail of a finger when the distal phalanx of said finger is inserted into the aperture 22 of the absorbent member 20. The softening and solvating action of the liquid solvent acts to loosen a polish coating from a nail thus received within the aperture 22, the mechanical action of the walls of the aperture 22 further facilitating the removal of the polish coating from the nail.

The absorbent member 20 is preferably formed of a high density cellular foam material such as polyurethane or similar "plastic" and such as is employed in presently available commercial nail polish removal devices such as that device marketed under the trademark "Just Dip" of Cameo, Inc., of Toledo, Ohio. A similar material is described in U.S. Pat. No. 4,282,891 and is also seen to be generally suitable for formation of the absorbent member 20. The aperture 22 in the absorbent member 20 can be formed either as a cylindrical channel extending throughout the absorbent member 20 or as one or more slits which effectively form an aperture within the absorbent member 20. In the event that more than one slit is used to form the aperture 22, the slits preferably intersect medially of the lengths thereof.

The treatment container 12 can be closed by disposition of the threaded lid 18 over the opening 16, the opening 16 having mating threads formed thereabout to engage the threads of the lid 18 in a known manner such that the treatment container 12 can be closed when not in use. Evaporation of the liquid solvent through the opening 16 is thereby reduced and leakage or spillage of the liquid solvent from the container 12 is prevented. In structure and intended operation, the treatment container 12 is thus seen to be similar to commercially available nail treatment devices such as the "Just Dip" device referred to above and such as is generally disclosed in U.S. Pat. No. 4,282,891. The liquid solvent used in the treatment container 12 can take a variety of known forms and is typically chosen to be a solution of acetone and selected conditioning substances. However, the treatment container 12 is seen to effectively surmount and cooperate with the supply container 14 which holds a given quantity of the liquid solvent in storage separate from the liquid solvent which is being used at any given time within the treatment container 12. The supply container 14 is preferably chosen to comprise a container formed of glass or similar material which is impervious to the liquid solvent and is capable of storing said solvent without evaporative loss through the walls of the container 14. The supply container 14 can be chosen as shown in FIGS. 1–4 to have a relatively large base compared to the diameter of the treatment container 12 such that the device 10 is resistant to being accidentally tipped over or otherwise caused to become imbalanced. The supply container 14 stores a quantity of liquid solvent sufficient to allow multiple recharging of the treatment container 12 when the liquid solvent within the treatment container 12 has become sufficiently contaminated to warrant cleaning of the absorbent member 20 and removal of used liquid solvent from the container 12.

As particularly seen in FIGS. 1–4, the treatment container 12 is integrally formed with and surmounts a lowermost cap portion 26, the cap portion 26 being internally threaded at 28 to allow positive closure of opening 30 on neck 32 of the supply container 14. The neck 32 is seen to be formed with external threads 34 which mate with the internally threaded cap portion 26 to secure the treatment container 12 to the supply container 14. It is to be noted that the opening 30 of the supply container 14 has a smaller diameter than that of the opening 16 of the treatment container 12, this reduced diameter of the opening 30 resulting in a somewhat lower liquid solvent loss from an open supply container 14 than is experienced from an open treatment container 12. In the prior art, nail polish removal devices contain the total amount of liquid solvent within a wide-mouthed container and thus lose a given amount of solvent by evaporation when such devices are opened and particularly when such devices are allowed to remain open for substantial periods of time. In the present nail polish removal device 10, the maintenance of a substantial portion of the liquid solvent within the supply container 14 having a reduced opening 30 results in lower loss of solvent through said opening 30 as compared to losses through openings of prior devices and even through the opening 16 of the treatment container 12. Since the present nail polish removal device 10 is capable of maintaining a substantial supply of liquid solvent within the supply container 14, the treatment container 12 can be made smaller than is the case with prior art nail polish removal devices since the treatment container 12 does not have to be sufficiently large to contain substantial quantities of liquid solvent sufficient for use over a relatively long period of time. Through use of the present device 10, relatively smaller quantities of liquid solvent can be contained within the treatment container 12 and used until effectively spent, the absorbent member 20 then being removed from the treatment container 12 and cleaned and the spent liquid solvent discarded, the supply of liquid solvent then being replenished into the treatment container 12 from the supply container 14. The treatment container 12 and absorbent member 20 can thus be of a relatively small size which results in material savings.

The nail polish removal device 10 is further configured such that the treatment container 12 can be replenished with liquid solvent from the supply container 14 without removal of the cap portion 26 (and thus the treatment container 12) from surmounting relation with and connection to the supply container 14. Liquid solvent replenishment is preferably accomplished by disposition of a valve 36 in the cap portion 26 which communicates the interior of the treatment container 12 with the interior of the supply container 14. The valve 36 is seen to comprise an aperture 38 formed in the lower portion of a valve stem 40, the aperture 38 communicating the interior of the treatment container 12 through the cylindrical valve stem 40 with the interior of the supply container 14. The stem 40 is seen to extend into the interior of the treatment container 12 a distance which is chosen to be greater than the depth of the liquid solvent which is contained within the treatment container 12. The extension of the upper end 42 of the stem 40 above the level of the liquid solvent within the container 12 prevents flow of the liquid solvent back into the supply container 14. A cap 43 can be disposed over the end 42 to prevent backflow through the end 42. The valve stem 40 is offset from the longitudinal axis of the container 12 in order that the aperture 22 in the absorbent member 20 can be centrally disposed for receiving at least the distal phalanx of a finger thereinto for removal of polish from a nail. An offset aperture 44 is conveniently provided in the absorbent member 20 to receive the valve stem 40, the offset aperture 44 extending from the lower unexposed face of the absorbent member 20 and terminating at a point within the body of the absorbent 20 such that the aperture 44 does not exit the absorbent member 20 on the exposed face 24 thereof. The offset of the aperture 38 and valve stem 40 from the longitudinal axis of the container 12 is chosen to be sufficient to avoid contact between the elevated valve stem 40 and a finger inserted into the aperture 22 of the absorbent 20 while maintaining the aperture 38 and thus the interior lumen of the stem 40 in communication with the supply container 14 through the opening 30 of said container 14.

While the valve 36 can take a variety of forms, a ball valve structure is conveniently utilized due to the effectiveness of such a valve and due also to manufacturing economy and simplicity of operation. The valve 36 is thus seen to contain a captive ball element 46 which is maintained within the valve stem 40 by means of an annular stop element 48 disposed at the lower portion of the stem 40 and by the cap 43 at the upper end of the stem 40. The ball element 46 is seen to close the aperture 38 when the device 10 is in a vertical position with the treatment container 12 surmounting the supply container 14. In this position, liquid solvent remains within the supply container 14 and the container 14 is effectively closed from communication with the treatment container 12 by means of the seating of the ball element 46 against the lower annular stop element 48. On inversion of the device 10, the ball element 46 is displaced against the cap 43 disposed over the end 42 of the valve stem 40, thereby allowing liquid solvent from the supply container to flow through side apertures 52 formed in the walls of the valve stem adjacent the floor of the treatment container 12. The side apertures 52 thus allow flow of liquid solvent through the aperture 38 and discharge of the liquid solvent from the valve stem 40 to the interior of the treatment container 12. It is to be recognized that charging of the treatment container 12 thus described with liquid solvent from the supply container 14 occurs as a result of the inversion of the device 10 such that the supply container 14 surmounts the treatment container 12 when the container 12 is being replenished with liquid solvent. During this replenishment process, the lid 18 is secured over the opening 16 of the treatment container 12 to prevent loss of liquid solvent through the opening 16. In order to charge a desired quantity of liquid solvent into the treatment container 12 on inversion of the device 10, the rate of liquid solvent flow through the side apertures 52 is gauged according to the dimensions of the aperture 38 and of the side apertures 52 such that the device 10 is inverted for a predetermined period of time, for example, for a period of approximately 5 seconds, such that a sufficient quantity of liquid solvent is caused to flow through the valve 36 and into the interior of the treatment container 12. The orientation of the device 10 is then returned to the "normal" or non-charging position such that the treatment container 12 again surmounts the supply container 14. The treatment container 12 is thus replenished with liquid solvent from the supply container 14 in a simple and rapid operation which does not require the removal of the cap portion 26 from engagement with the supply container 14.

While the absorbent members useful with the invention expand when wetted with liquid solvent and thus act due to this expansion to form a friction fit within a treatment container, additional retaining structure can be provided within a treatment container 50 of FIG. 5 to further prevent accidental or unintentional dislodgement of the absorbent member 20 from the interior of the container 50. The container 50 is essentially identical to the container 12 of FIGS. 1–4. An annular ridge 54 can be seen to be formed about interior side walls of the container 50 immediately above and adjacent to absorbent member 51 in order to maintain said member 51 within the container 50. Alternatively, the treatment container 50 can be configured to provide an enclosed chamber having a shoulder portion at the upper portions thereof which effectively reduces the diameter of the opening of the container 50, such an opening being of a diameter less than the diameter of the essentially cylindrical absorbent member 51 to provide an additional capability for retention of the absorbent member 51 within the container 50.

FIG. 6 illustrates the use of a retainer plate 56 which can be disposed over an opening in a treatment container 59 such that the retainer plate 56 is removably mounted in surmounting relation to an absorbent member 57. An annular bead 58 formed on side walls of treatment container 59 allows the plate 56 to be snap-fit into the container 59 and to allow removal thereof when it is desired to clean the absorbent member 57. The retainer plate 56 is seen to be formed with a central aperture 60 which allows a finger to be received therethrough and into an aperture 61 formed in the absorbent member 57. The aperture 60 can further serve as a guide for directing the finger into the aperture 61 formed in the absorbent member 57.

Referring now to FIGS. *7a* and *7b*, a treatment container 62 is seen to be provided with a metering valve arrangement seen generally at 63. In operation, the treatment container 62 and associated supply container (not shown) are inverted and the liquid solvent flows into inner liquid chamber 64 through opening 65 in floor 66 of the container 62. The air in the inner chamber 64 displaced by the liquid solvent is conveyed into the interior of the supply container (not shown) through chambers 67 and 68 and opening 69 of siphon tube 70. The liquid solvent continues to rise in the liquid chamber 64 while the treatment container 62 and associated supply container are inverted. When the liquid solvent pouring into the inner liquid chamber 64 rises above the level of dispensing tube 71, automatic siphon flow is established and liquid is drawn upwardly between the tube 71 and the siphon tube 70 and outwardly through the dispensing tube 71 until the liquid level drops below the rim of the siphon tube 70 whereupon flow ceases and the liquid level in the liquid chamber 64 again begins to rise for repetition of the dispensing cycle. Once the level of liquid solvent within the treatment container 62 has reached a predetermined level, such as through one or more filling cycles, flotation ball 72 floats upwardly (given that the treatment container 62 and associated supply container remain inverted) to seat against stop element 76 and thus block apertures 73 formed in the dispensing tube 71. During filling of the treatment container 62, the liquid solvent flows through the apertures 73 formed near distal end 74 of the tube 71. Vent tube 75 acts to communicate the inner liquid chamber 64 with the "ambient atmosphere" represented by the interior of the treatment container 62, thereby allowing a venting necessary to maintenance of flow through the dispensing tube 71. The dispensing tube 71 and the vent tube 75 are offset from the longitudinal axis of the substantially cylindrical treatment container 62 to allow formation of finger receiving recess 80 in absorbent member 81, the tubes 71 and 75 being received into apertures formed in the absorbent member 81 in a manner similar to that referred to hereinabove. The outermost ends of the dispensing tube 71 and vent tube 75 extend a distance which is sufficient to cause said ends to be above the normal level of liquid solvent within the treatment container 62.

A predetermined quantity of liquid solvent is thus dispensed into the treatment container 62 from associated supply container (not shown) through the metering valve arrangement 63. It is to be understood that the flotation ball 72 need not be utilized in the event that it is desired to simply invert the device for a predetermined period of time or a predetermined number of cycles. It is also to be understood that the treatment container 62 is formed with a cap portion 78 having threads 77 which mate with threads on a supply container as is shown hereinabove. A threaded lid 79 is also affixed to the treatment container 62 as is described above and as is conventional in the art.

The metering arrangement 63 can typically take the form of that liquid dispensing valve arrangement described in U.S. Pat. No. 3,220,618, the disclosure of which is incorporated hereinto by reference. Further, a number of siphon flow metering valve arrangements are described in the prior art which can be readily adapted for use with the present structure. In particular, the metering valve arrangements of the following patents can be utilized herewith, the disclosures of the U.S. Pat. Nos. listed below being incorporated hereinto by reference:

1,862,801, 2,193,043, 2,208,862, 2,209,947, 2,229,122, 2,442,133, 2,546,188, 2,667,290, 2,678,757, 2,689,671, 3,081,008, 3,097,769, 3,184,106, 3,193,160, 3,254,808, 3,263,872, 3,707,247, 3,919,456, 3,968,907.

Referring now to FIG. 8, a further embodiment of the invention can be seen at 80 to comprise a nail polish removal device having a treatment container 82 which surmounts a supply container 83 through a cap element 84 which closes the supply container 83 in a manner essentially identical to the previous description of the device 10. In the device 80, however, the cap element 84 is not integral with the treatment container 82 but comprises threaded wall portions 86 which secure the cap element 84 to the supply container in a manner such as is described relative to the device 10. The cap element 84 is further seen to have an annular groove 88 formed in an upper portion thereof to receive an annular bead 90 formed on interior walls of an extended annular skirt portion 92 of the treatment container 82. The bead 90 of the treatment container 82 fits within the groove 88 of the cap element such that the treatment container 82 can be rotated relative to the cap element 84. A small amount of "play" is provided between the groove 88 and the bead 90 to accommodate movements necessary to operate the device 80. Top wall 94 of the cap element 84 is provided with an opening 96 and a blind depression 98, the opening 96 and the blind depression 98 being alignable respectively with an open tube 100 and a closed tube 102 formed on the exterior surface of bottom wall 104 of the treatment container 82. The cap element 84 can thus be rotated relative to the treatment container 82 such that either the open tube 100 or the closed tube 102 aligns with either the opening 96 or the blind depression 98 on the cap element 84. Annular beads 103 and 105 formed on upper surfaces of the top wall 94 allow snap-fitting of the tubes 100 and 102 into place. As can thus be understood, the interior of the treatment container 82 is open to the interior of the supply container 83 when the opening 96 aligns with the open tube 100. When in this position, liquid solvent can be dispensed into the treatment container 82 through the cap element 84. An absorbent member (not shown) held within the treatment container 82 can thus have liquid solvent replenished thereto as desired by inversion of the device 80 to cause liquid solvent to flow under the influence of gravity through the aligned opening 96 and the open tube 100. In this embodiment, only a central aperture needs to be formed in the absorbent member for receipt of at least a portion of the finger thereinto.

Considering now the embodiment of FIG. 9, a nail polish removal device is seen generally at 110 to comprise a treatment container 112 and a supply container 114. The supply container 114 is seen to be provided with a cap 116 which is threaded in a conventional manner to be secured to a threaded neck 118 of the supply container. The treatment container 112 is seen to be integrally formed with the cap 116 to cause the treatment container 112 to be connected to the supply container 114 in surmounting relation thereto. It can thus be seen in this embodiment that the respective interiors of the treatment container 112 and supply container 114 do not communicate through the cap 116. Replenishment of liquid solvent from the supply container 114 is accomplished by removal of the cap 116 and integral treatment container 112 from surmounting relation to the supply container 114 to allow pouring of the liquid solvent from the supply container 114 into the treatment container 112, thereby to impregnate absorbent member 120 with liquid solvent. On wetting of the absorbent member 120, and the cap 116 and the integral treatment container 112 is replaced on the supply container 114 in connected relation thereto such that the containers 112 and 114 are maintained together to prevent separation of the containers from each other, thereby maintaining a supply of liquid solvent with the treatment container to prevent separation of the liquid solvent supply from the nail treating portion of the device 110. A separate cap can be used to close the supply container 114 if desired with a collar formed integrally with the treatment container 112 being fitted over such a separate cap.

It can thus be understood that the invention can take a variety of forms including those embodiments particularly described herein. In particular, the retaining elements described above can be utilized with any of the embodiments of the invention without departing from the intent of the invention. Various other structural features may also be combined even if not shown explicitly in the drawings or described hereinabove without departing from the scope of the invention as recited in the appended claims.

What is claimed is:

1. A device for treating the nails, comprising:

a treatment container;

an absorbent member disposed within the treatment container and being wetted with a nail treating liquid, the absorbent member having at least one aperture centrally formed therein to receive a nail thereinto;

a supply container separate from the treatment container and holding a quantity of the nail treating liquid for replenishment of said liquid to the treatment container, the treatment container being carried by the supply container to form an associated unit and thereby to maintain the quantity of liquid in proximity to the treatment container, the supply container having an opening over which the treatment container is disposed and thereby carried by the supply container; and, means communicating between the treatment container and the supply container for facilitating flow of the nail treating liquid from the supply container to the treatment container and for precluding flow of the nail treating liquid from the treatment container to the supply container, said means comprising cap means carried by the treatment container for connecting the treatment container to the supply container in surmounting relation to the supply container and for closing the opening of the supply container, and valve means carried by the cap means for communicating the interior of the supply container with the interior of the treatment container and for providing a conduit through which the nail treating liquid can be caused to flow from the supply container into the treatment container, the valve means further comprising a hollow cylindrical stem extending substantially vertically into the treatment container and being fixed therein and having at least one aperture formed therein to allow flow of liquid into the treatment container through said stem on inversion of the device, the stem being offset relative to the aperture formed centrally in the absorbent member, the absorbent member having an aperture formed therein to receive the stem, the outermost end of the stem extending into the treatment container a sufficient distance to cause said end to be disposed above the desired fluid level of the body of liquid contained within the treatment container.

2. The device of claim 1 wherein the supply container is formed of a material which is substantially impervious to evaporation of the nail treating liquid through walls thereof.

3. The device of claim 2 wherein the supply container is formed of glass.

4. The device of claim 1 wherein the nail treating liquid comprises a nail polish removal solvent.

5. The device of claim 4 wherein the absorbent member is formed of a cellular sponge-like material and wherein the absorbent member substantially fills the interior of the treatment container.

6. The device of claim 5 wherein the aperture in the absorbent member extends substantially vertically throughout the absorbent member.

7. The device of claim 1 and further comprising retaining means carried by the treatment container for preventing dislodgment of the absorbent member from the treatment container.

8. The device of claim 7 wherein the retaining means comprise an annular ridge disposed in surmounting relation to the absorbent member and extending partially across an opening of the treatment container.

9. The device of claim 7 wherein the retaining means comprises a retainer plate disposed in surmounting relation to the absorbent member extending across an opening of the treatment container, the retainer plate having an opening formed therein to receive a finger and to guide the finger into the aperture formed in the absorbent member.

10. The device of claim 1 wherein the valve means further comprise:

a ball retained within the hollow cylindrical stem and movable therein to a first position allowing flow of liquid into the treatment container from the supply container upon inversion of the device and to a second position blocking flow of liquid through said at least one aperture on disposition of the device with the treatment container surmounting the supply container, the ball preventing backflow of the liquid into the supply container on disposition of the device whereby the treatment container surmounts the supply container; and, means for retaining the ball within the hollow cylindrical stem and for allowing movement of said ball to the respective positions.

11. The device of claim 10 wherein a plurality of apertures are formed in walls of the stem in a substantially horizontal plane lying medially of the distance between the outermost end of the stem and the means retaining the ball at the opposite end of the stem.

12. The device of claim 11 wherein the distance between the apertures and the outermost end of the stem is sufficient to allow the ball to be displaced sufficiently toward the outermost end of the stem to be clear of a blocking relation to the apertures.

13. The device of claim 1 wherein the outermost end of the stem is closed by means of a cap.

14. The device of claim 1 wherein the cap means is formed integrally with the treatment container.

15. The device of claim 1 wherein the cap means removably closes the opening of the supply container.

16. The device of claim 1 wherein the supply container has an opening over which the treatment container is disposed and thereby carried by the supply container, the last mentioned means comprising:

cap means carried by the treatment container for connecting the treatment container to the supply container in surmounting relation to the supply container and for closing the opening of the supply container; and, metering means carried by the cap means for communicating the interior of the supply container with the interior of the treatment container and for providing a conduit through which the nail treating liquid can be metered in predetermined quantity from the supply container into the treatment container.

17. The device of claim 16 wherein the metering means meters a predetermined quantity of nail treating liquid into the treatment container from the supply container on inversion of the device.

18. The device of claim 16 wherein the cap means is formed integrally with the treatment container.

19. The device of claim 16 wherein the metering means is disposed in an offset relation to the aperture centrally formed in the absorbent member.

20. The device of claim 1 wherein the supply container is formed with a larger base than the base of the treatment container.

* * * * *